US005235246A

United States Patent [19]

Konishi

[11] Patent Number: 5,235,246

[45] Date of Patent: Aug. 10, 1993

[54] ELECTROLUMINESCENCE PANEL

[75] Inventor: Tsuneo Konishi, Shiga, Japan

[73] Assignee: NEC Corporation, Tokyo, Japan

[21] Appl. No.: 855,492

[22] Filed: Mar. 23, 1992

Related U.S. Application Data

[63] Continuation of Ser. No. 420,595, Oct. 12, 1989, abandoned.

[30] Foreign Application Priority Data

Oct. 13, 1988 [JP] Japan ..... 63-258038

[51] Int. Cl.[5] ..... H05B 33/02; H05B 33/22

[52] U.S. Cl. ..... 313/509; 313/506

[58] Field of Search ..... 313/506, 509

[56] References Cited

U.S. PATENT DOCUMENTS 4,188,565 2/1980 Mizukami et al. ..... 313/509

4,686,110 8/1987 Endo et al. ..... 313/509

5,066,551 11/1991 Kojima ..... 313/506 X

FOREIGN PATENT DOCUMENTS 103390 8/1978 Japan ..... 313/509

*Primary Examiner*—Sandra L. O'Shea

*Attorney, Agent, or Firm*—Leydig, Voit & Mayer

[57] ABSTRACT

In an electroluminescence panel, first and second charge injection refraining layers are formed between transparent electrodes and a first insulating layer and between back electrodes and a second insulating layer, respectively, and first and second charge injecting layers are formed between the first insulating layer and an emitting layer and between the second insulating layer and the emitting layer, respectively. The charge injection refraining layers suppress the injection of charges into the first and second insulating layers to enhance the ability of the panel to withstand the applied voltages, and the charge injecting layers inject a large quantity of charges into the emitting layer to increase the luminance. Further, the fabricating efficiency is not lowered.

4 Claims, 3 Drawing Sheets

ELECTROLUMINESCENCE PANEL

This application is a continuation of U.S. patent application Ser. No. 07/420,595, filed Oct. 12, 1989 now abandoned.

FIELD OF THE INVENTION

This invention relates to an electroluminescence panel and more particularly, to a thin film electroluminescence panel which has superior luminance and an enhanced ability to withstand applied voltages without breaking down.

BACKGROUND OF THE INVENTION

A conventional electroluminescence panel comprises a transparent substrate such as a glass plate, plural transparent electrodes such as indium tin oxide (ITO) provided on the transparent substrate, a first insulating layer such as a metal oxide or metal nitrides formed on the transparent electrodes, an emitting layer such as zinc sulfide doped with Mn or a rare earth element or an alkaline earth metal sulfide doped with selenium sulfide and a rare earth element provided on the first insulating layer, a second insulating layer of the same material as the first insulating layer formed on the emitting layer, and a plural back electrodes such as aluminum provided on the second insulating layer. The electroluminescence panel is used for a display device to display letters or figures by applying a determined voltage across selected transparent and back electrodes according to information supplied to the display device. Luminance and the ability to withstand applied voltages without breaking down are important properties of the panel. For this purpose, various electroluminescence panels have been proposed, especially, with regard to the characteristics of the insulating layers. In particular an electroluminescence panel preferably has the following properties (1) The insulating layer has a high dielectric constance and breakdown voltage.

(2)The insulation layer is self-healing after breakdown.

(3) It is easy to inject charges into the emitting layer to increase the luminance.

(4) It is difficult to inject the charges into the insulation layers from electrodes.

Although it is difficult for a single insulating material to meet all of these requirements, Japanese Patent Kokai (laid-open) Nos. 58-29880 and 62-278794 have proposed electroluminescence panels which provide improvements in one or more of the above properties.

Japanese Patent Kokai No. 58-29880 discloses an electroluminescence panel which includes an insulating layer that comprises a material having a high dielectric constant and a perovskite structure. An additional layer of $Y_2O_3$ having a thickness of 100 to 1000 Å is provided between the insulating layer and an emitting layer. This facilitates injecting charges into the emitting layer and enhances luminance. Japanese Patent Kokai No. 62-278794 discloses three types of electroluminescence panels. Each type includes two insulating layers comprising a first insulating layer in contact with an emitting layer and a second insulating layer in contact with an electrode. In the first type of electroluminescence panel, the first insulating layer and the second insulating layer are formed from $Ta_2O_5$ of low and high resistances, by respectively sputtering method. In the second type of electroluminescence panel, the second insulating layer comprises of $SiO_2$ which is provided by an electron beam evaporation method. In the third type of electroluminescence panel, a first insulating layer of low resistivity $Ta_2O_5$ is formed by an electron beam evaporation method.

However, the above described electroluminescence panels have certain disadvantages.

In the electroluminescence panel of Japanese Patent Kokai No. 58-29880, since a three element material having a perovskite structure is used for the insulating layer, it is difficult to maintain stoichiometry or obtain a predetermined dielectric constant, thereby reducing the breakdown voltage. Further, the breakdown mode is liable to propagate in the insulating layer.

In the first type of electroluminescence panel of Japanese Patent Kokai No. 62-278794, charges are easily injected into the second insulation layer of high resistivity $Ta_2O_5$. Consequently, the ability of the panel to withstand applied voltages without breaking down is limited. Further, in manufacturing this panel, the ITO electrode tends to be black where the second insulating layer of $Ta_2O_5$ is formed directly on the electrode by the sputtering method. In addition, the emitting layer is subject to damage and exfoliation of the film occurs where $Ta_2O_5$ is formed by the sputtering method on zinc sulfide (ZnS), which is a mother material for the emitting layer.

In the second type of electroluminescence panel of Japanese Patent Kokai No. 62-278794, the electron beam evaporation method and the sputtering method are carried out one after the other in the fabrication process. As a result, the process is complicated. Further, the ability of the panel to withstand the applied voltages is limited, and the panel is likely to be contaminated due to the supply to and the discharge from the vacuum chamber during fabrication. In addition, this type of panel is subject to the same emitting layer damage and exfoliation as the first type.

In the third type of electroluminescence panel of Japanese Patent Kokai No. 62-278794, deviation of the composition tends to occur in the first insulating layer of $Ta_2O_5$ based on the stoichiometry. Although the layer is suitable for a charge injection layer, the layer may need to be as thick as 10,000 Å to provide as adequate breakdown voltage. In this case, the emitting threshold voltage and a driving voltage must unduly increased.

SUMMARY OF THE INVENTION

Accordingly, it is an object of this invention to provide an electroluminescence panel which has the basic property of high luminance and an enhanced ability to withstand applied voltages.

It is a further object of this invention to provide an electroluminescence panel having thin film layers that resist exfoliation.

It is a still a further object of this invention to provide an electroluminescence panel which is fabricated without increasing the number of steps or the cost of fabrication.

According to this invention, an electroluminescence panel includes:

a transparent substrate;

a plurality of stripe-shaped transparent electrodes provided on the transparent substrate and extending parallel to one another in a first direction;

a first charge injection refraining layer formed on the transparent electrodes;

a first insulating layer formed on the first charge injection refraining layer;

a first charge injecting layer formed on the first insulating layer;

an emitting layer provided on the first charge injecting layer;

a second charge injecting layer formed on the emitting layer;

a second insulating layer formed on the second charge injecting layer;

a second charge injection refraining layer formed on the second insulating layer;

a plurality of strip-shaped back electrodes provided on said second charge injection refraining layer and extending parallel to one another in a second direction orthogonal to the first direction;

wherein the first and second charge injection refraining layers are formed by a sputtering method to suppress the injection of charges from the transparent and back electrodes to the first and second insulating layers, respectively;

the first and second insulating layers are formed by a sputtering method; and the first and second charge injecting layers are formed by an electron beam evaporation method to inject charges into the emitting layer.

BRIEF DESCRIPTION OF THE DRAWINGS

The invention will be explained in more detail in conjunction with appended drawings, wherein.

DESCRIPTION OF THE PREFERRED EMBODIMENT

Figure 1:
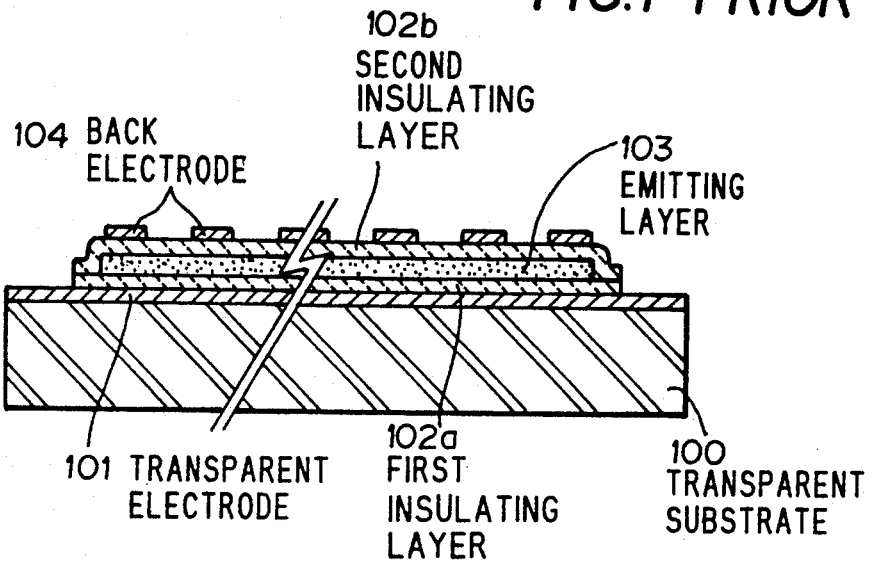
FIG.1 PRIOR ART
FIG. 1 is a cross-sectional view showing a conventional electroluminescence panel.

Before explaining an electroluminescence panel embodying the embodiment according to the invention, the aforementioned conventional electroluminescence panel will be explained with reference to FIG. 1. The conventional electroluminescence panel comprises (1) a transparent substrate 100 which may comprise a glass plate (2) plural transparent electrodes 101 which may comprise parallel stripes of a material such as ITO and which are provided on the transparent substrate 100 (3) a first insulating layer 102*a* which may comprise a metal oxides or a metal nitride and which formed on the transparent electrodes 101, (4) an emitting layer 103 which may comprise zinc sulfide doped with Mn or a rare earth element or an alkaline earth metal sulfide doped with selenium sulfide and a rare earth element and which is provided on the first insulating layer 102*a* (5) a second insulating layer 102*b* which may comprise the same material as the first insulating material 102*a* and which is formed on the emitting layer 103, and (6) plural back electrodes 104 which may comprise aluminum and which is provided on the second insulating layer 102*b*.

In operation, a predetermined voltage which is larger than a threshold voltage of the emitting layer 103 is applied across selected transparent electrodes 101 and selected back electrodes 104 according to information to be displayed on the electroluminescence panel. Light is then emitted from the emitting layer 103 through the transparent electrodes 101 and the transparent substrate 100 to the outside based on the pattern of the applied voltage. As a result, the information is displayed on the electroluminescence panel. The disadvantages of this electroluminescence panel were explained previously.

Figure 2:
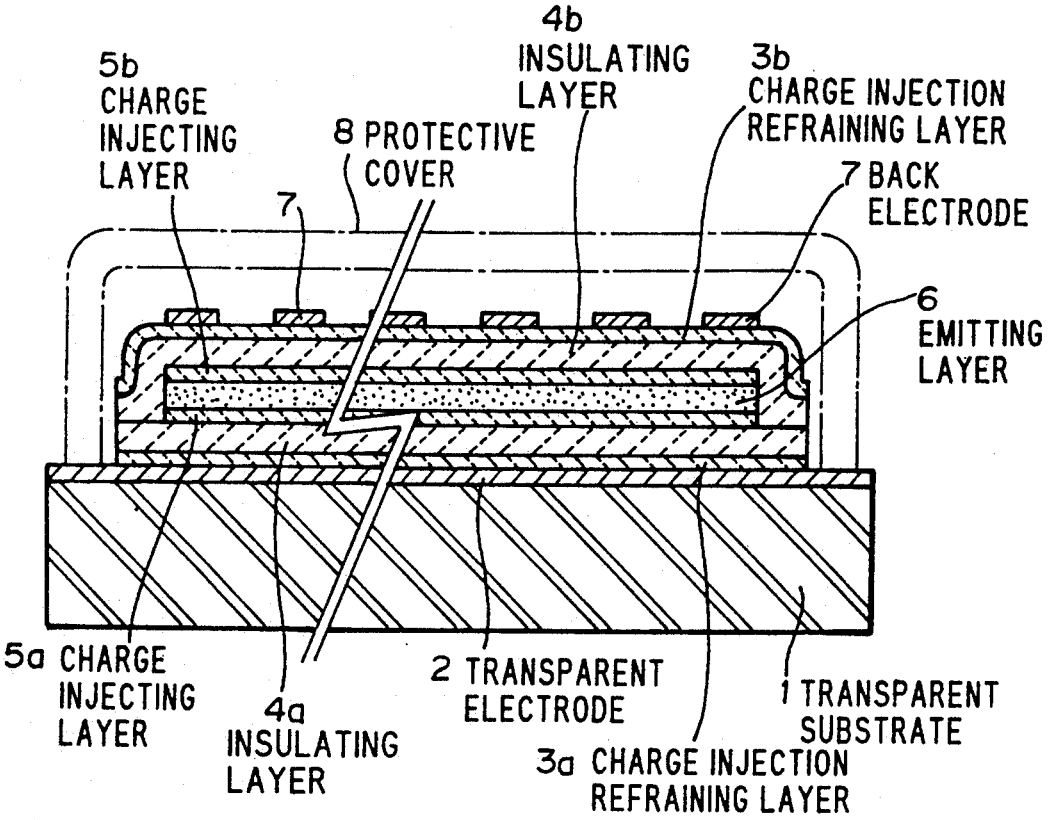
FIG. 2 is a cross-sectional view showing an electroluminescence panel in a preferred embodiment according to the invention.
Figure 3:
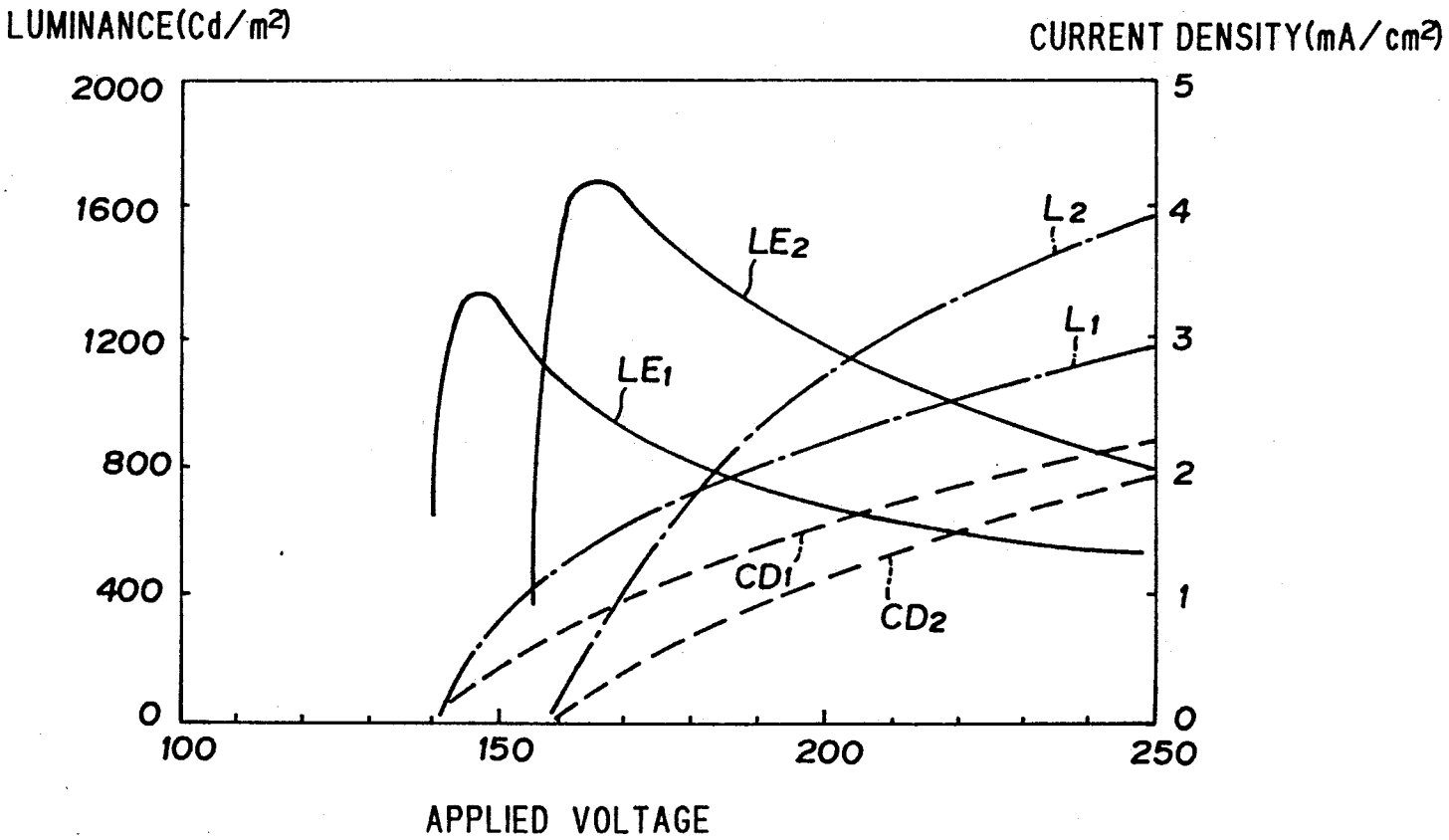
FIG. 3 is a graph indicating relationships between a conventional electroluminescence panel and an electroluminescence panel in the preferred embodiment with respect tot he luminous efficiency, the luminance, and the current density.
Figure 4A:
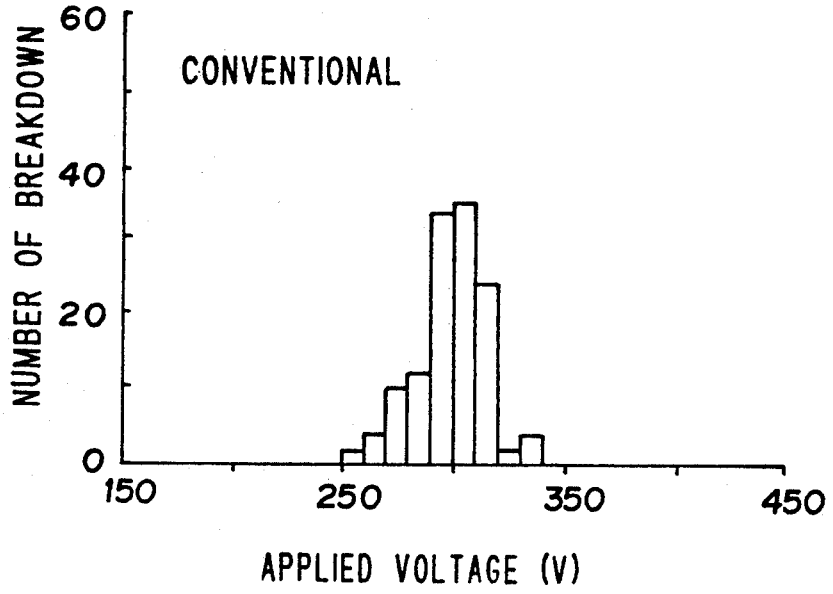
FIGS. 4A and 4B are graphs showing the number of break-downs by applied voltage for both conventional electroluminescence panels and electroluminescence panels in the preferred embodiment.
Figure 4B:
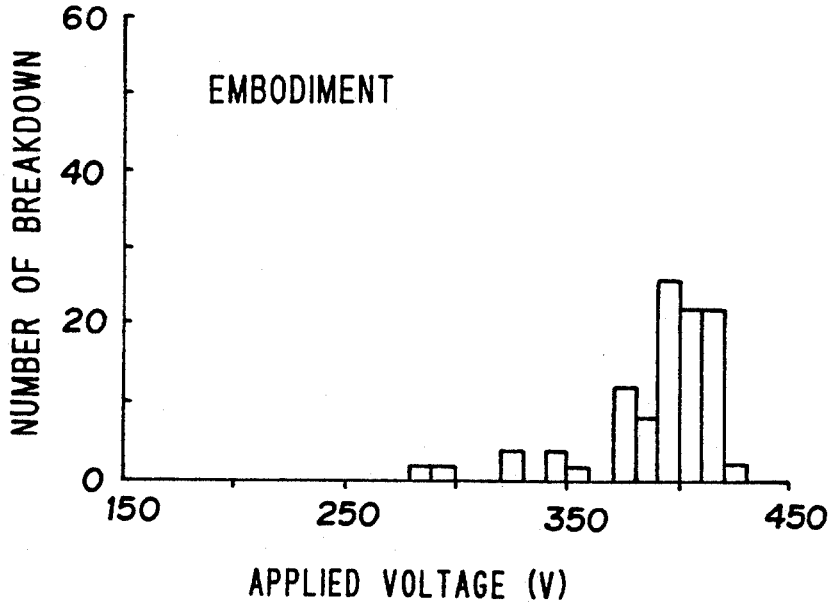

An electroluminescence panel embodying the invention will now be explained with reference to FIG. 2. The electroluminescence panel comprises a transparent substrate 1, plural transparent electrodes 2 provided on the transparent substrate 1, a charge injection refraining layer 3*a* formed on the transparent electrodes 2, a first insulating layer 4*a* formed on the refraining layer 3*a*, a charge injecting layer 5*a* formed on the first insulating layer 4*a*, an emitting layer 6 positioned on the charge injecting layer 5*a*, a charge injecting layer 5*b* formed on the emitting layer 6, a second insulating layer 4*b* formed on the charge injecting layer 5*b*, a charge injection refraining layer 3*b* formed on the second insulating layer 4*b*, and plural back electrodes 7 provided on the refraining layer 3*b*. The electroluminescence panel further comprises a protective cover 8 such as a glass cover under which an insulating fluid is provided to protect the above described layers.

The transparent electrodes 2 may comprise a transparent electrode material such as ITO and may be in the form of parallel stripes which extend orthogonal to the back electrodes 7. The back electrodes 7 may comprise each a metal such as aluminum.

Upon application of a predetermined voltage to selected transparent and back electrodes 2,7, light is emitted from the region of the emitting layer 6 at which the selected transparent and back electrodes 2,7 intersect. The first and second insulating layers 4*a* and 4*b* preferably comprise $Ta_2O_5$ and are formed by a sputtering method. The thickness of the layers 4*a* and 4*b* is adjusted to be from 3000 to 5000 Å in order to provide the desired insulating property but prevent the emission threshold voltage from being too high. The light emitting layer 6 is formed with a light emitting material such as zinc sulfide doped with Mn (ZnS:Mn) by an electron beam evaporation method or a resistive heating evaporation method and is adjusted to be approximately 5000 Å in thickness.

The charge injection refraining layers 3*a* and 3*b*, the provision of which is one feature of the invention, are formed from an insulating material such as silica ($SiO_2$), alumina ($Al_2O_3$), or silicon nitride ($Si_3N_4$) by a sputtering method in the same manner as the formation of the first and second insulating layers 4*a* and 4*b*. The charge injection refraining layers 3*a*, 3*b* are positioned between the transparent electrodes 2 and the first insulating layer 4*a* and between the back electrodes 7 and the second insulating layer 4*b*. The insulating material of the charge injection refraining layers 3*a* and 3*b* is dense and stable, so that the injection of charges from the transparent and back electrodes 2 and 7 to the first and second insulating layers 4*a* and 4*b*, respectively, is suppressed. This increases the breakdown voltage and the luminous efficiency because it reduces leakage current. It also reduces heating. In addition, the charge injection retions and alternative constructions that may occur to one skilled in the art which fairly fall within the basic teaching herein set forth.

What is claimed is:

1. An electroluminescence panel comprising:

a transparent substrate;

a plurality of stripe shaped transparent electrodes provided on said transparent substrate and extending parallel to one another in a first direction;

a first charge injection refraining layer formed on said transparent electrodes;

a first insulating layer formed on said first charge injection refraining layer;

a first charge injecting layer on said first insulating layer;

an emitting layer provided on said first charge injecting layer;

a second charge injecting layer formed on said emitting layer;

a second insulating layer formed said second charge injecting layer;

a second charge injection refraining layer formed on said second insulating layer; and a plurality of stripe shaped back electrodes provided on said second charge injection refraining layer and extending parallel to one another in a second direction orthogonal to said first direction;

wherein said first and second charge injection refraining layers are formed by a sputtering method to suppress the injection of charges from said transparent and back electrodes to said first and second insulating layers respectively;

said first and second insulating layers are formed by a sputtering method; and said first and second charge injecting layers are formed by an electron beam evaporation method to inject charges into said emitting layer.

2. An electroluminescence panel, according to claim 1, wherein:

said first and second charge injecting layers are formed consecutively after and before the formation of said emitting layer without breaking vacuum of a common chamber; and said first and second charge injection refraining layers are formed consecutively with the formation of said first and second insulating layers without breaking vacuum of a common chamber.

3. An electroluminescence panel according to claim 1 wherein:

said first and second charge injection refraining layers are from 100 to 500 Å in thickness and comprise at least one insulating material selected from silicon oxide, aluminum oxide, and silicon nitride;

said first and second insulating layers are from 3,000 to 5,000 Å in thickness, comprise an insulating material of tantalic pentaoxide, and are formed by a sputtering method; and said first and second charge injection layers are from 300 to 500 Å in thickness and comprise at least one insulating material selected from yttrium oxide, tantalic pentaoxide, silicon oxide, and aluminum oxide.

4. An electroluminescence panel according to claim 3 wherein said first and second insulating layers comprise tantalic pentaoxide, said first and second charge injection refraining layers comprise silicon oxide, and said first and second charge injecting layers comprise yttrium oxide.

* * * * *